US009412293B2

(12) United States Patent
Minami

(10) Patent No.: US 9,412,293 B2
(45) Date of Patent: Aug. 9, 2016

(54) DIGITAL DATA TRANSMISSION APPARATUS AND DIGITAL DATA TRANSMISSION METHOD

(71) Applicant: Mitsubishi Electric Corporation, Tokyo (JP)

(72) Inventor: Akihiro Minami, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 167 days.

(21) Appl. No.: 14/249,288

(22) Filed: Apr. 9, 2014

(65) Prior Publication Data

US 2014/0320463 A1 Oct. 30, 2014

(30) Foreign Application Priority Data

Apr. 26, 2013 (JP) ..... 2013-093349

(51) Int. Cl.
*G09G 3/20* (2006.01)
*G09G 3/36* (2006.01)

(52) U.S. Cl.
CPC ..... *G09G 3/2096* (2013.01); *G09G 3/3611* (2013.01); *G09G 2330/06* (2013.01); *G09G 2370/14* (2013.01)

(58) Field of Classification Search
CPC ..... G09G 3/2096; G09G 3/3611; G09G 2330/06; G09G 2370/14
See application file for complete search history.

(56) References Cited

U.S. PATENT DOCUMENTS

| | | | | |
|---|---|---|---|---|
| 6,344,850 | B1 * | 2/2002 | Okumura | G06F 3/1415 345/100 |
| 7,596,263 | B2 * | 9/2009 | Sasaki | G09G 3/3611 382/162 |
| 2004/0179002 | A1 * | 9/2004 | Park | G09G 3/3611 345/204 |
| 2005/0111571 | A1 * | 5/2005 | Wang | G09G 3/3611 375/295 |
| 2005/0237316 | A1 * | 10/2005 | Huang | G09G 3/3648 345/204 |
| 2009/0303224 | A1 | 12/2009 | Yoshida | |
| 2009/0309860 | A1 * | 12/2009 | Hsu | G09G 3/3685 345/211 |
| 2010/0164845 | A1 | 7/2010 | Takagi et al. | |
| 2012/0127153 | A1 | 5/2012 | Yukawa | |

FOREIGN PATENT DOCUMENTS

| | | | |
|---|---|---|---|
| JP | 2008-287154 | A | 11/2008 |
| JP | 2009-294379 | A | 12/2009 |
| JP | 2010-210693 | A | 9/2010 |
| WO | 2011/007613 | A1 | 1/2011 |

* cited by examiner

*Primary Examiner* — Lun-Yi Lao
*Assistant Examiner* — Elliott Deaderick
(74) *Attorney, Agent, or Firm* — Studebaker & Brackett PC

(57) ABSTRACT

The present invention has a comparing unit that compares each of image signals in a first clock period with a corresponding one of the image signals in a second clock period subsequent to the first clock period, and a cancelling unit that causes each of the image signals in the second clock period to be cancelled in the case where a comparison result from the comparing unit indicates that each of the image signals in the first clock period agrees with the corresponding one of the image signals in the second clock period.

14 Claims, 13 Drawing Sheets

DIGITAL DATA TRANSMISSION APPARATUS AND DIGITAL DATA TRANSMISSION METHOD

BACKGROUND OF THE INVENTION

1. Field of the Invention

The present invention relates to a data transmission apparatus and a data transmission method and particularly to a data transmission apparatus and a data transmission method for serially transmitting a plurality of image signals to an image display device by using digital data which has the image signals allocated in a single clock period.

2. Description of the Background Art

For the purpose of power saving and reduction of the number of transmission links, data transmission apparatuses adopting such technologies as LVDS (Low voltage differential signaling) which serially transmits a plurality of image signals by allocating (mapping) the image signals in a single clock period have been widely used (for example, Japanese Patent Application Laid-Open Nos. 2008-287154 and 2010-210693). That transmission method identifies each of the plurality of allocated image signals by detecting a voltage difference between paired two wires.

SUMMARY OF THE INVENTION

In the above described transmission method, due to the feature of compressing a plurality of image signals in a single clock period for transmission, a High state and a Low state of the digital data on the transmission link need to be alternated for identification of each of the image signals. The High state and the Low state of the digital data on the transmission link are defined on the basis of the amount of a voltage difference between the paired two wires.

In order to meet the above described requirement, the High state and the Low state of the digital data need to be alternated between the respective image signals allocated in a single clock period even in the case where the whole screen is displayed, for example, in monochrome. The alternation of the High state and the Low state of the digital data disturbs the power saving effect, and the alternation of the High state and the Low state on the transmission link causes noise (EMI: Electro-Magnetic Interference) emitted as electromagnetic waves.

Many of the images are displayed on personal computers and the like in a neutral monochrome color, and, in fact, these images suffer from noise (EMI) caused by the alternation of the High state and the Low state of the digital data on the transmission link.

For reducing such noise, a transmitter and a receiver for transmitting the digital data need to have complex arithmetic circuits. Japanese Patent Application Laid-Open Nos. 2008-287154 and 2010-210693 are intended to reduce noise (EMI) by performing mathematical operations on digital data in LVDS differential interface or the like, therefore, their transmitters and receivers are provided with complex arithmetic circuits.

Further, since each of the image signals allocated in a single clock period is temporally compressed and mapped, the frequency of alternation of the High state and the Low state of the digital data on the transmission link is several times that of the clock period. Therefore, the alternation further accelerates the generation of noise emitted as electromagnetic waves.

The present invention provides a data transmission apparatus and a data transmission method which are capable of having the data transmission apparatus reduce noise generated in transmission links by using a simple configuration, wherein the data transmission apparatus serially transmits a plurality of image signals to an image display device by using digital data which has the image signals allocated.

The data transmission apparatus according to an aspect of the present invention is a data transmission apparatus that serially transmits a plurality of image signals to an image display device by using digital data which has the image signals allocated in a single clock period, including: a comparing unit that compares each of the image signals in a first clock period with corresponding one of the image signals in a second clock period subsequent to the first clock period; and a cancelling unit that causes each of the image signals in the second clock period to be cancelled in the case where a comparison result from the comparing unit indicates that each of the image signals in the first clock period agrees with corresponding one of the image signals in the second clock period.

The data transmission method according to an aspect of the present invention is a data transmission method for serially transmitting a plurality of image signals to an image display device by using digital data which has the image signals allocated in a single clock period, including the steps of: (a) comparing each of the image signals in a first clock period with corresponding one of the image signals in a second clock period subsequent to the first clock period; and (b) causing each of the image signals in the second clock period to be cancelled in the case where a comparison result in the step (a) indicates that each of the image signals in the first clock period agrees with corresponding one of the image signals in the second clock period.

According to the above described aspect of the present invention, each of the image signals in the second clock period is cancelled in the case where each of the image signals in the first clock period agrees with corresponding one of the image signals in the second clock period. Therefore, the present invention can reduce noise generated in transmission links only with a simple configuration by transmitting digital data which has the respective cancelled image signals allocated.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments will be described below with reference to the accompanying drawings.

Figure 1:
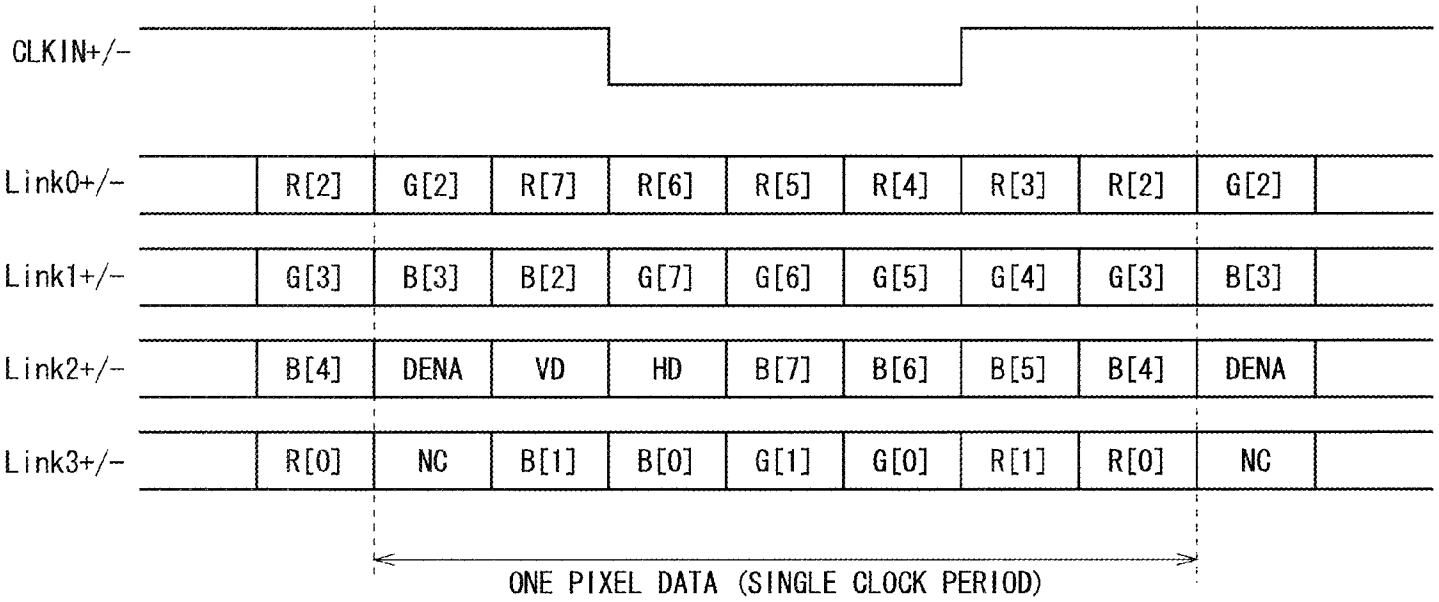
FIG. 1 is a view illustrating a mapping configuration of image signals to be input to a liquid crystal module according to an underlying technique.

FIG. 1 is a view illustrating a mapping configuration of 8-bit RGB image signals to be input to a liquid crystal module via a transmission technology of LVDS according to an underlying technique.

In FIG. 1, respective signals indicate image signals represented by Red (R[7] to R[0]), Green (G[7] to G[0]), or Blue (B[7] to B[0]) and respective control signals indicating details of control to be performed on an image including a horizontal synchronizing signal (HD), a vertical synchronizing signal (VD), and a data enable signal (DENA). In the mapping configuration, unused parts (time domains which have none of the image signals or the like allocated) are labeled NC.

Figure 2:
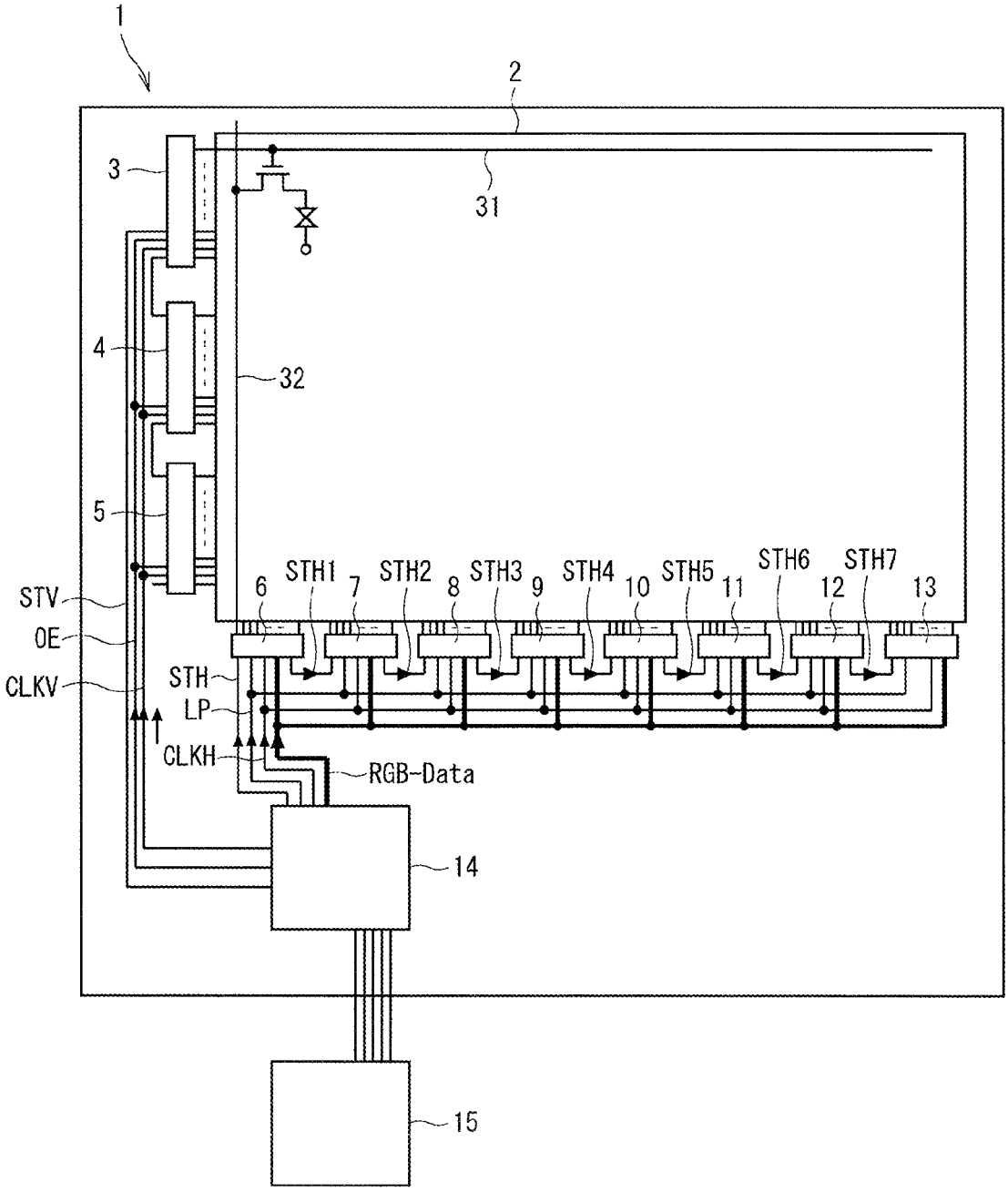
FIG. 2 is a schematic view illustrating input of the signals into the liquid crystal module according to an underlying technique.
Figure 3:
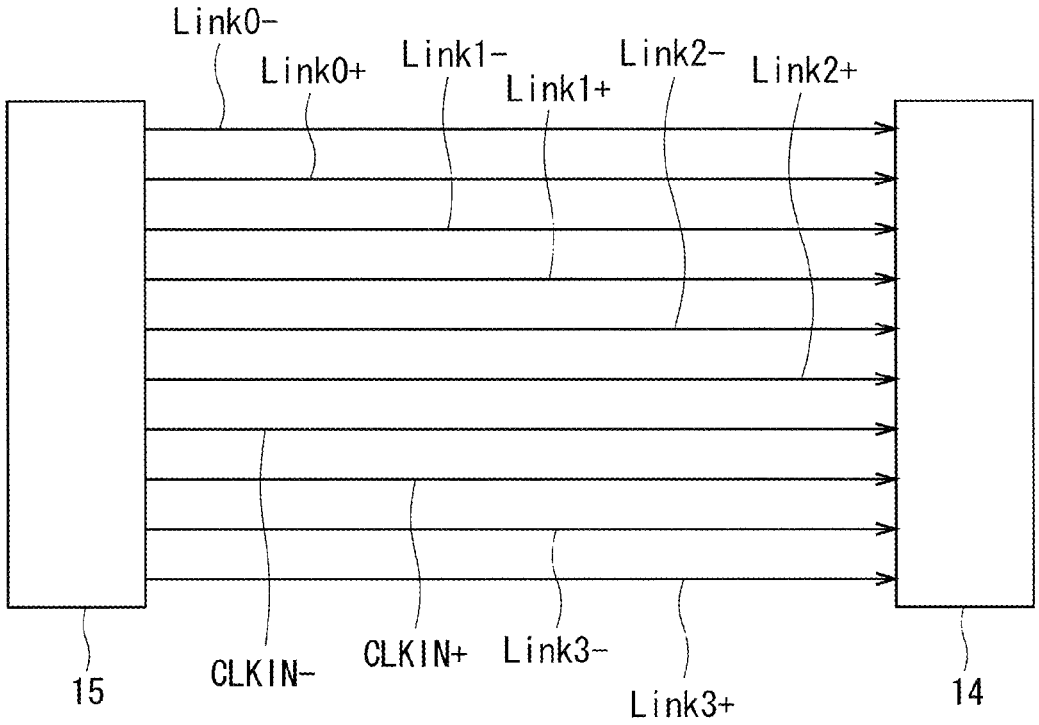
FIG. 3 is a view illustrating connection of transmission lines between a scaler chip and a timing controller according to the underlying technique.

FIG. 2 is a schematic view illustrating input of the signals into a liquid crystal module 1. FIG. 3 is a view illustrating connection of transmission links between a scaler chip 15 (at a transmitter side) and a timing controller 14 (at a receiver side) of FIG. 2.

The liquid crystal module 1 has a liquid crystal panel 2, scanning line driving circuits 3 to 5 which are connected with the liquid crystal panel 2 and drive scanning lines 31, image signal line driving circuits 6 to 13 which are connected with the liquid crystal panel 2 and drive image signal lines 32, a timing controller 14 which is connected with the scanning line driving circuits 3 to 5 and the image signal line driving circuits 6 to 13, and a scaler chip 15 which is connected with the timing controller 14. The scaler chip 15 (at a transmitter side) and the timing controller 14 (at a receiver side) correspond to the data transmission apparatus in the liquid crystal module 1.

In FIG. 2, a horizontal start pulse STH, a reference horizontal clock CLKH, a latch pulse LP, a gate driver output enable signal OE, a vertical clock CLKV, and a vertical start pulse STV are illustrated.

As illustrated in FIG. 2, LVDS is used in a section between the circuit for scaling the signals to a resolution for each liquid crystal module (the scaler chip 15) and the liquid crystal module 1. Since data is transmitted through pairs of two wires (data lines) as illustrated in FIG. 3, a combination of Link0+ and Link0− is labeled Link0+/−, a combination of Link1+ and Link1− is labeled Link1+/−, a combination of Link2+ and Link2− is labeled Link2+/−, and a combination of Link3+ and Link3− is labeled Link3+/−.

Similarly, since clock signals are transmitted through a pair of two wires (clock lines), a combination of CLKIN+ and CLKIN− is labeled CLKIN+/− (though, unnecessary wires are partly omitted).

In the case where 8-bit RGB image signals are transmitted via LVDS as illustrated in FIG. 1, the pair of clock lines (CLKIN+/−) and the four pairs of data lines (Link0+/−, Link1+/−, Link2+/−, Link3+/−) are used in the transmission.

The image signals (R[7] to R[0], G[7] to G[0], and B[7] to B[0]) and the control signals (DENA, HD, and VD) of the allocated signals are temporally compressed and mapped for each clock period as illustrated in FIG. 1 so that they are transmitted through the four pairs of data lines respectively. As a result, the number of the whole transmission links (wires) is reduced.

Figure 4:
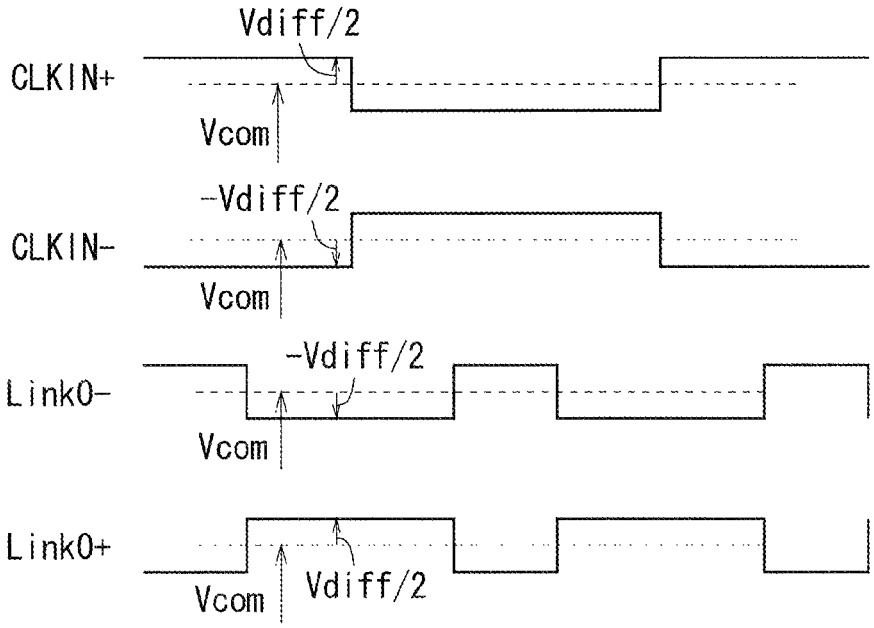
FIG. 4 is a view illustrating transmission of digital data units opposite to each other according to the underlying technique.

Here, as a result of transmission of the digital data units opposite to each other through CLKIN+ and CLKIN−, Link0+ and Link0−, Link1+ and Link1−, Link2+ and Link2−, and Link3+ and Link3−, respectively as illustrated in FIG. 4 (Link1+ and Link1−, Link2+ and Link2−, and Link3+ and Link3− are omitted in the figure), low amplitude, energy saving, and fast communications are implemented.

A difference between voltage values opposite to each other applied to the paired wires with respect to a voltage Vcom applied to the wires as a bias are detected as differential voltages Vdiff, and based on the differential voltages Vdiff, whether the digital data unit is a digitally High state (at a High level) or a digitally Low state (at a Low level) is determined.

However, the High state and the Low state of the digital data units on the transmission link are alternated for identification between the respective image signals, therefore, even in the case where the whole screen is displayed, for example, in monochrome, the High state and the Low state of the digital data are alternated between the respective image signals allocated in a single clock period. The alternation of the High state and the Low state of the digital data disturbs the power saving effect and causes noise (EMI).

Preferred embodiments below relate to the data transmission apparatus which can solve the above described problems and reduce EMI generated in transmission links only with a simple configuration.

First Preferred Embodiment

Although a liquid crystal display device (liquid crystal module) will be exemplified in the preferred embodiment below, the present invention can be applied to a data interface (data transmission apparatus) between a display controller and an image display device including an organic electroluminescence display device and a plasma display.

Figure 14:
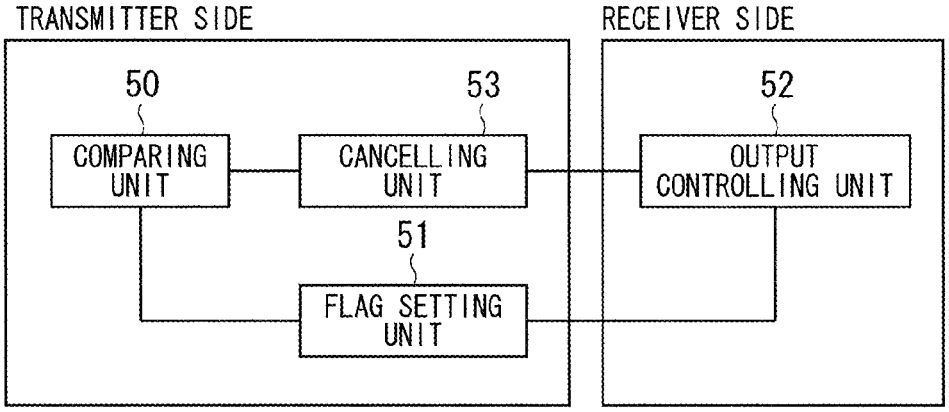
FIG. 14 is a view illustrating a functional configuration of a data transmission apparatus according to the preferred embodiment.

FIG. 14 is a view illustrating a functional configuration of a data transmission apparatus according to the present invention.

As illustrated in FIG. 14, the data transmission apparatus has a comparing unit 50, a cancelling unit 53, a flag setting unit 51, and an output controlling unit 52. Among these functional units, the comparing unit 50, the cancelling unit 53, and the flag setting unit 51 are arranged at the transmitter side of the data transmission (corresponding to the scaler chip 15, for example). On the other hand, the output controlling unit 52 is arranged at the receiver side of the data transmission (corresponding to the timing controller 14, for example). The flag setting unit 51 may be omitted. Detailed operation of the respective functional units will be described later.

Figure 5:
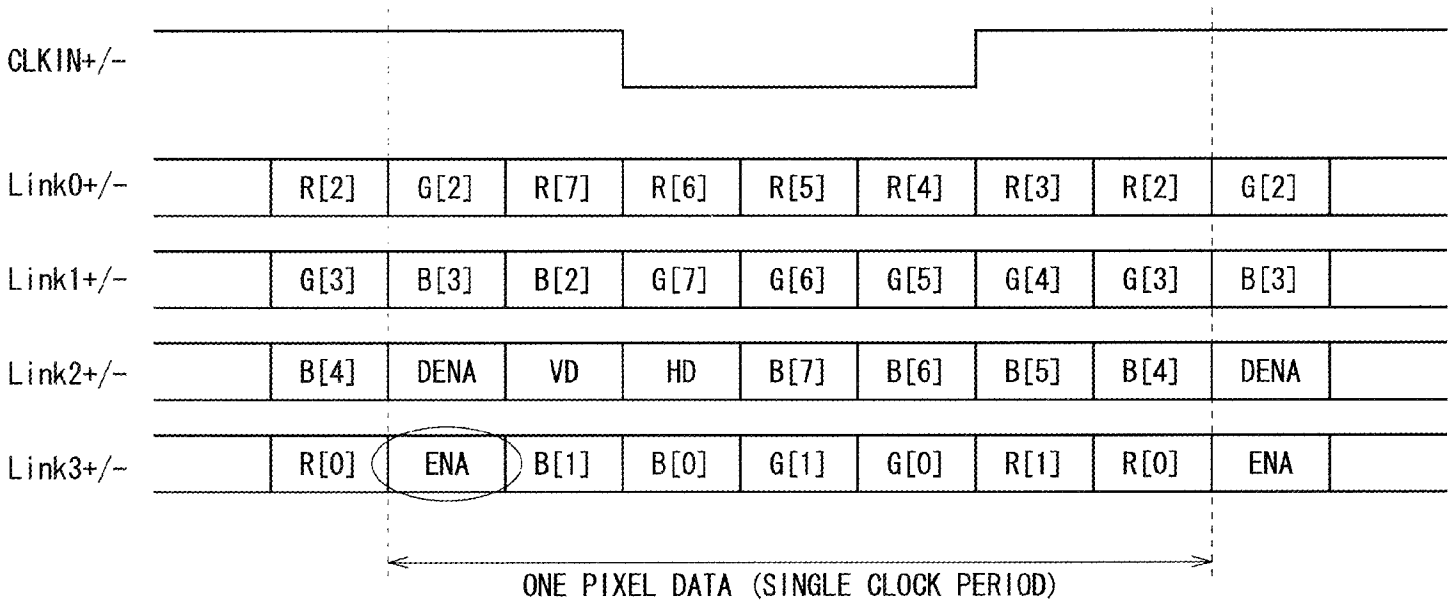
FIG. 5 is a view illustrating a mapping configuration of image signals to be input to a liquid crystal module according to a preferred embodiment.

FIG. 5 is a view illustrating a mapping configuration of image signals to be input to a liquid crystal module according to the first preferred embodiment. Specifically, the view illustrates a case where 8-bit RGB image signals are input to the liquid crystal module via a transmission technology of LVDS.

In FIG. 1, the mapping contains the time domains (mapping regions) each of which is labeled NC and is not used for any purpose. In contrast, in FIG. 5, the time domains (mapping regions) each of which has been labeled NC are used as time domains for setting flag signals (here, the flag signal is labeled ENA).

A differential signal represented by LVDS is for distinguishing between the digitally High state and the digitally Low state based on a difference between opposite two signals. For avoiding confusion, the preferred embodiment will be described on the assumption that "the High state=1 in the digital signal" and "the Low state=0 in the digital signal" instead of on the basis of real waveforms.

Figure 6:
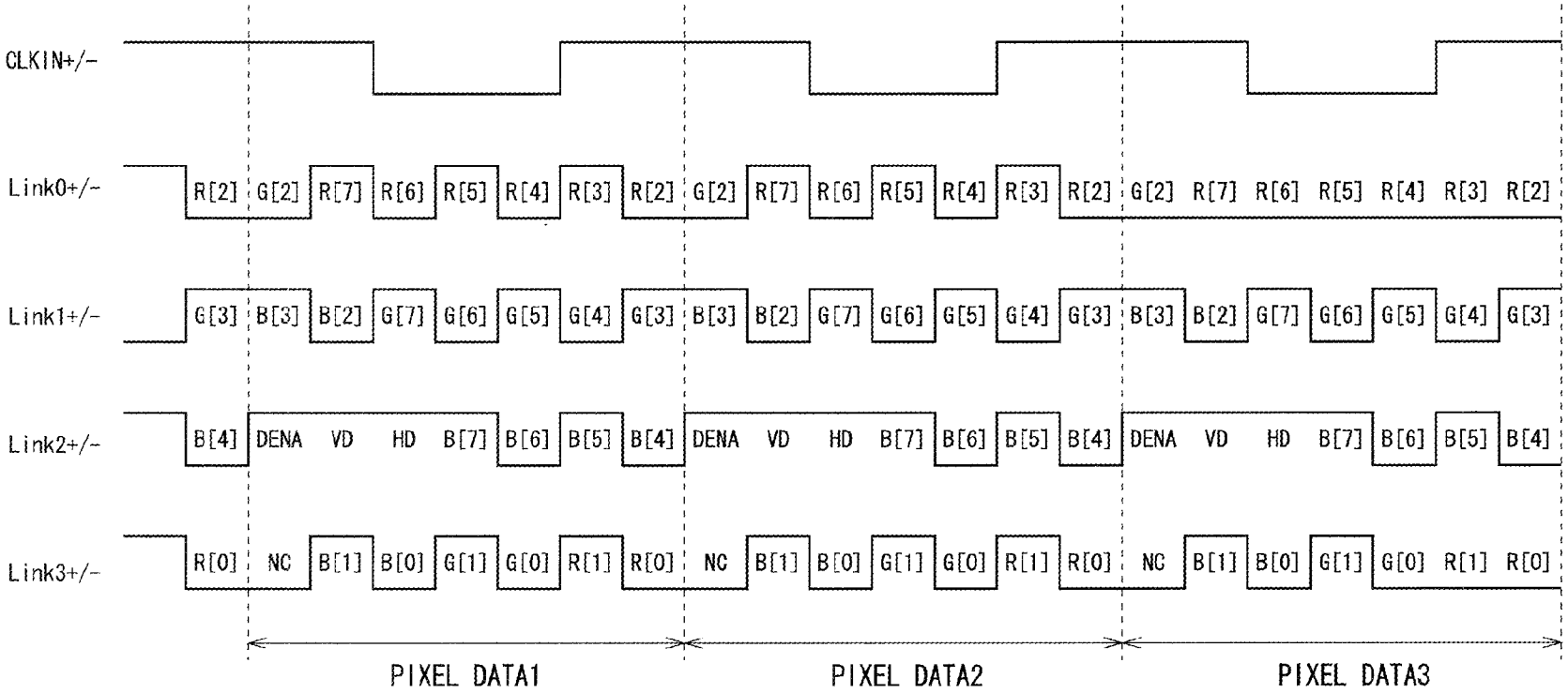
FIG. 6 is a view illustrating a mapping configuration of image signals including a High state and a Low state of the digital data on each of transmission links according to the underlying technique.

FIG. 6 is a view illustrating a mapping configuration of image signals including the High state and the Low state of the digital data on the transmission links. FIG. 6 corresponds to FIG. 1 (the underlying technique).

Illustrated is an example that 170 gradations are in a pixel DATA1 for each of RGB, the mapping of the image signals (including the High state and the Low state of the digital data) of the pixel DATA1 is repeated in a pixel DATA2, and only the brightness for red of the pixel DATA1 and the pixel DATA2 is set to 0 (in the Low state) in a pixel DATA3.

In the preferred embodiment, the image signals are valid while DENA (data enable signal) is set to the High state. HD (horizontal synchronizing signal) is in an active period when it is set to the High state. VD (vertical synchronizing signal) is in an active period when it is set to the High state.

Since all of DENA, HD, and VD are in the High state in FIG. 6, the image signals (R[7] to R[0] (red brightness data), G[7] to G[0] (green brightness data), B[7] to B[0] (blue brightness data)) mapped in the same periodic band represent display data of valid pixels belonging to the clock period. R[7], G[7], and B[7] represent MSBs (Most Significant Bits) of respective data. R[0], G[0], and B[0] represent LSBs (Least Significant Bits) of respective data.

Figure 7:
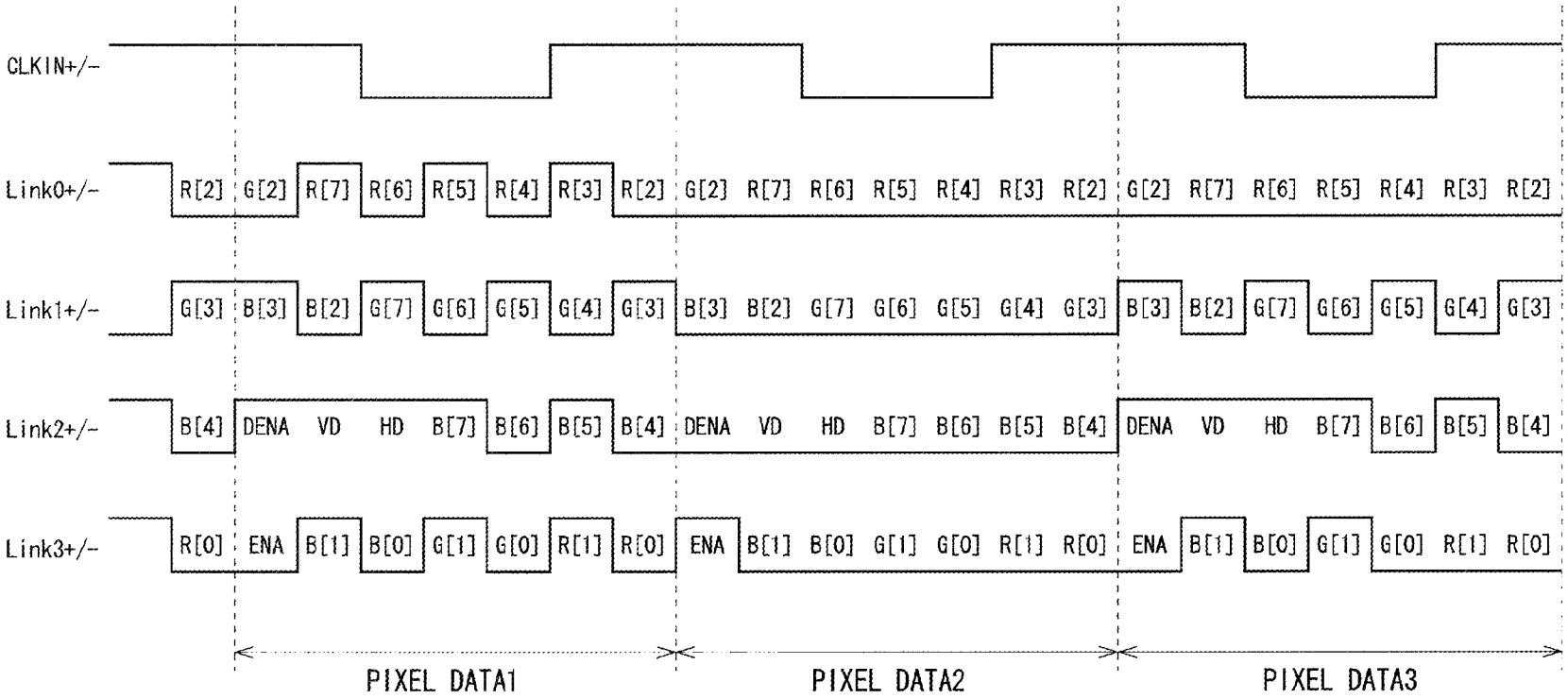
FIG. 7 is a view illustrating a mapping configuration of image signals including the High state and the Low state of the digital data on each of transmission links according to the preferred embodiment.

On the other hand, FIG. 7 is also a view illustrating a mapping configuration of image signals including the High state and the Low state of the digital data on the transmission links. FIG. 7 corresponds to FIG. 5 (the first preferred embodiment).

In FIG. 7, the time domains labeled NC in FIG. 6 are labeled ENA and used as time domains for setting flag signals.

Illustrated in the pixel DATA2 is the digital data which has ENA set to the High state and the other digital data units (at least the image signals) set to the Low state in response to the case where the digital data units (at least the image signals) other than ENA which have been mapped in the preceding clock period (the pixel DATA1 period) and the digital data units (at least the image signals) other than ENA mapped in the pixel DATA2 period are the same.

In the preferred embodiment, when the image signals are to be mapped at the transmitter side, the comparing unit 50 of the data transmission apparatus compares the digital data units (at least the image signals) other than ENA which have been mapped in the preceding clock period with the corresponding digital data units (at least the image signals) other than ENA which have been mapped in the next clock period. In the case where at least some of the digital data units are different, the flag setting unit 51 of the data transmission apparatus sets ENA to the Low state (i.e., sets a flag signal (mark) indicating the comparison result) and outputs the other digital data units intact (i.e., by keeping the time domains which have the respective signals allocated and the High state or the Low state of the respective signals as they are) (corresponding to the pixel DATA3). Then, the digital data is transmitted on the transmission links.

In contrast, in the case where the comparing unit 50 of the data transmission apparatus compares the digital data units (at least the image signals) other than ENA which have been mapped in the preceding clock period with the corresponding digital data units (at least the image signals) other than ENA which have been mapped in the next clock period to find that they are the same (all of the digital data units are the same), the flag setting unit 51 of the data transmission apparatus sets ENA to the High state (i.e., sets a flag signal (mark) indicating the comparison result) and the cancelling unit 53 of the data transmission apparatus sets all of the other digital data units to the Low state to cancel them (corresponding to the pixel DATA2). Then, the digital data is transmitted on the transmission links.

In response, at the receiver side, in the case where ENA is set to the Low state, the digital data in the clock period is recognized as it is, and in the case where ENA is set to the High state, the received digital data is not recognized and the digital data in the preceding clock period is to be reused.

Meanwhile, the above described "cancelling" refers to operation of causing two image signals which have been allocated to continuous (adjacent) time domains in a clock period to be in the same digital state (the High state or the Low state).

Figure 8:
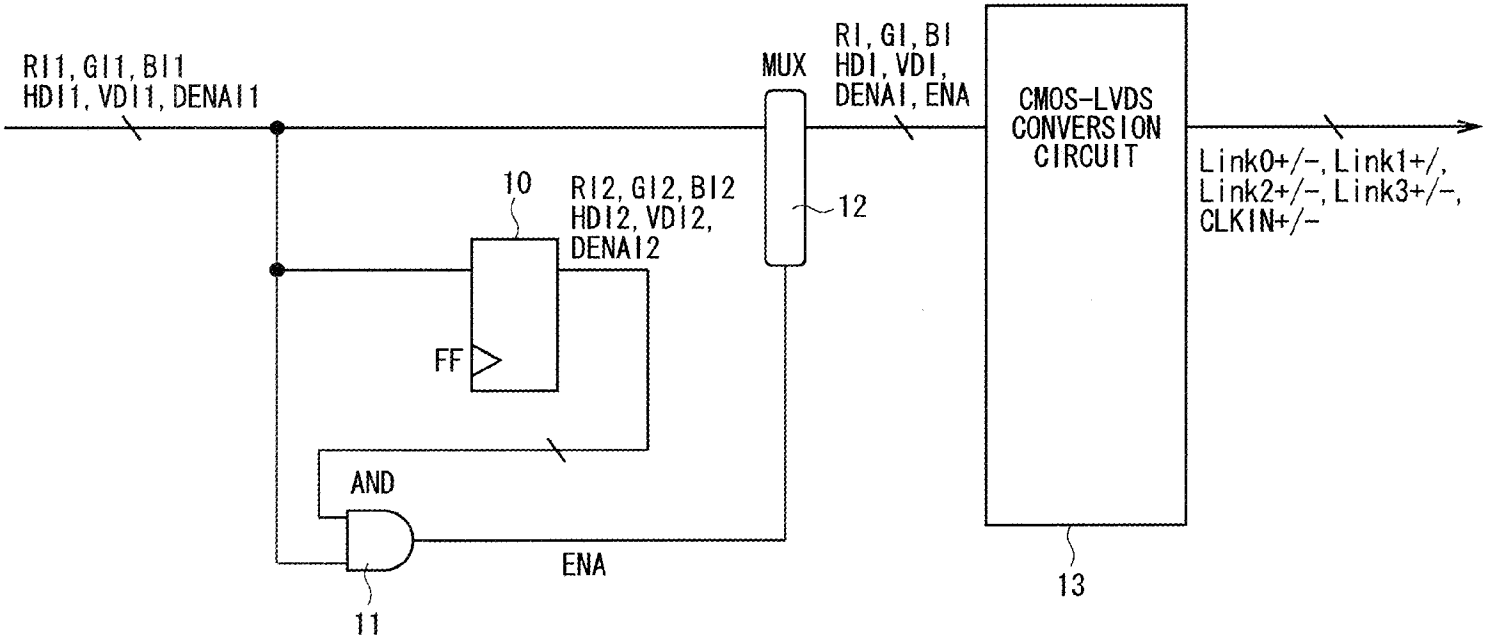
FIG. 8 is a view illustrating a circuit for implementing the preferred embodiment at a transmitter side.
Figure 9:
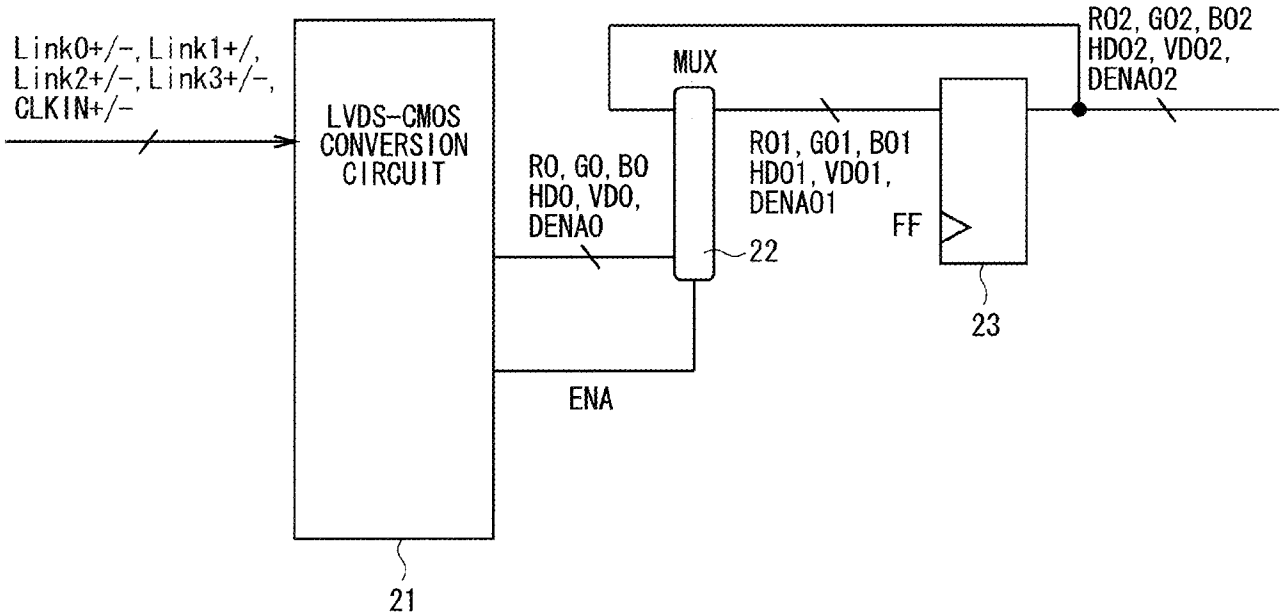
FIG. 9 is a view illustrating a circuit for implementing the preferred embodiment at a receiver side.

Now, circuits for implementing the first preferred embodiment at the transmitter side (corresponding to the above described scaler chip 15) are illustrated in FIG. 8 and circuits for implementing the first preferred embodiment at the receiver side (corresponding to the above described timing controller 14) are illustrated in FIG. 9.

In FIG. 8, a sequence of operation goes on as below.

The data transmission apparatus delays the image signals (RI1, GI1, BI1) and the control signals (HDI1, VDI1, DENAI1) by one clock at a flip-flop circuit 10 respectively to generate the image signals (RI2, GI2, BI2) and the control signals (HDI2, VDI2, DENAI2).

Subsequently, at an AND circuit 11, the data transmission apparatus compares the digital data in the preceding clock period (RI2, GI2, BI2, HDI2, VDI2, DENAI2) with the digital data in the next clock period (RI1, GI1, BI1, HDI1, VDI1, DENAI1) for each bit (corresponding to the comparing unit 50). Then, the data transmission apparatus compares all of the bits with each other, i.e., compares to determine whether the digital data in the preceding clock period completely agrees with the corresponding digital data in the next clock period or not.

The data transmission apparatus outputs the comparison result as ENA (corresponding to the flag setting unit 51), and in the case where ENA=the High state (in the case where the digital data units completely agree with each other), it outputs all of the digital data (RI, GI, BI, HDI, VDI, DENAI) from a MUX (multiplexer) 12 in the Low state (corresponding to the cancelling unit 53). In the case where ENA=the Low state (in the case where at least some of the digital data units disagree with each other), the data transmission apparatus outputs the digital data (RI1, GI1, BI1, HDI1, VDI1, DENAI1) intact as the digital data (RI, GI, BI, HDI, VDI, DENAI) from the MUX 12 to a CMOS-LVDS conversion circuit 13. Then, the digital data is transmitted on the transmission links.

In FIG. 9, a sequence of operation goes on as below.

ENA output from an LVDS-CMOS conversion circuit 21 as a CMOS signal is used in a MUX 22 and, in the case where ENA=the High state (in the case where the digital data units completely agree with each other), the data transmission apparatus outputs the digital data in the preceding clock period which has been fed back to the MUX 22 (RO2, GO2, BO2, HDO2, VDO2, DENAO2) intact as the digital data (RO1, GO1, BO1, HDO1, VDO1, DENAO1) instead of using the received digital data (corresponding to the output controlling unit 52). In the case where the output controlling unit 52 refers to the received digital data to find that the image signals in the digital data are cancelled (for example, the image signals are set to the Low state) even though ENA is not set as a flag signal, the data transmission apparatus can also output the digital data in the preceding clock period which has been fed back to the MUX 22 (RO2, GO2, BO2, HDO2, VDO2, DENAO2) intact as the digital data (RO1, GO1, BO1, HDO1, VDO1, DENAO1) (corresponding to the output controlling unit 52).

In the case where ENA=the Low state (in the case where at least some of the digital data units disagree with each other), the data transmission apparatus outputs the digital data in the next clock period (RO, GO, BO, HDO, VDO, DENAO) received as the digital data (RO1, GO1, BO1, HDO1, VDO1, DENAO1) intact (corresponding to the output controlling unit 52). In the case where the output controlling unit 52 refers to the received digital data to find that the image signals in the digital data are not cancelled (for example, inversions between the High state and the Low state remain in the image signals) even though ENA is not set as a flag signal, the data transmission apparatus can also output the received digital data in the next clock period (RO, GO, BO, HDO, VDO, DENAO) intact (corresponding to the output controlling unit 52).

The digital data (RO2, GO2, BO2, HDO2, VDO2, DENAO2) is the digital data (RO1, GO1, BO1, HDO1, VDO1, DENAO1) delayed for one clock in a flip-flop circuit 23, therefore, in the case where ENA=the High state, the above described operation is equivalent to the reuse of the digital data of the preceding clock period.

In the case where the digital data in the preceding clock period is output for reuse, all of the digital data units other than ENA are transmitted on the transmission links between the transmitter and the receiver as cancelled (in the Low state). Therefore, in that operation, the data transmission apparatus has reduced the number of inversions between the High state and the Low state on the transmission links between the transmitter and the receiver.

As described above, the present invention can be implemented only with addition of simple circuits at both of the transmitter side and the receiver side.

As a result, the preferred embodiment can reduce the number of inversions between the High state and the Low state, which are transmitted by means of difference, on the transmission links between the transmitter and the receiver by adding the simple circuits both at the transmitter side and the receiver side, therefore, the preferred embodiment can reduce noise emitted as electromagnetic waves from the transmission links.

Although the digital data units other than ENA (the control signals and the image signals) are supported in the description of the preferred embodiment, the preferred embodiment may be adapted to support only the image signals and not the control signals.

<Effects>

According to the preferred embodiment, the data transmission apparatus has the comparing unit 50 and the cancelling unit 53.

The comparing unit 50 is a function unit that compares each of the image signals in a first clock period with corresponding one of the image signals in a second clock period subsequent to the first clock period.

The cancelling unit 53 is a function unit that causes each of the image signals in the second clock period to be cancelled in the case where a comparison result from the comparing unit 50 indicates that each of the image signals in the first clock period agrees with corresponding one of the image signals in the second clock period.

According to the above described configuration, the cancelling unit 53 cancels each of the image signals in the second clock period in the case where each of the image signals in the first clock period agrees with corresponding one of the image signals in the second clock period. Therefore, the preferred embodiment can reduce noise generated in the transmission links by transmitting the digital data which has the respective cancelled image signals allocated.

According to the preferred embodiment, the cancelling unit 53 causes each of the image signals in the second clock period to be canceled by eliminating a difference between the High state and the Low state among the respective image signals allocated to continuous (adjacent) time domains of the second clock period.

With that configuration, the preferred embodiment can effectively reduce noise (EMI) caused by fluctuations of the digital data among the plurality of image signals in the serial transmission of the image signals.

According to the preferred embodiment, the data transmission apparatus further includes the flag setting unit 51.

The flag setting unit 51 is a function unit that sets a flag signal in the digital data in the second clock period in the case where a comparison result from the comparing unit 50 indicates that each of the image signals in the first clock period agrees with corresponding one of the image signals in the second clock period.

With that configuration, the preferred embodiment can easily determine whether each of the image signals in the received digital data is cancelled or not by referring to the flag signal at a receiving side of the digital data transmission (at the receiver side).

According to the preferred embodiment, the cancelling unit 53 causes all of the image signals in the second clock period to be canceled by setting the digital data except for the flag signal in the second clock period (at least the image signals) to the High state or to the Low state.

With that configuration, the preferred embodiment can reduce noise (EMI) caused by fluctuations of the digital data among the plurality of image signals in the serial transmission of the image signals.

According to the preferred embodiment, the flag setting unit 51 sets the flag signal to a time domain of the second clock period which has none of the image signals of the digital data allocated.

With that configuration, the preferred embodiment can set the flag signal by effectively using the time domain of the clock period which has none of the image signals allocated.

According to the preferred embodiment, the data transmission apparatus further includes the output controlling unit 52.

The output controlling unit 52 is a function unit that causes the image display device to output an image based on each of the image signals in the first clock period in the case where each of the serially transmitted image signals in the second clock period has been subjected to the cancelling.

With that configuration, the preferred embodiment can cause the image display device to display an appropriate image by reusing each of the image signals in the preceding clock period without using the cancelled image signals.

According to the preferred embodiment, the output controlling unit 52 causes the image display device to output an image based on each of the image signals in the first clock period in the case where the flag signal is set.

With that configuration, with reference to the flag signal, the preferred embodiment can reuse each of the image signals in the preceding clock period without using the cancelled image signals. Therefore, the preferred embodiment can cause the image display device to display an appropriate image.

Second Preferred Embodiment

Figure 10:
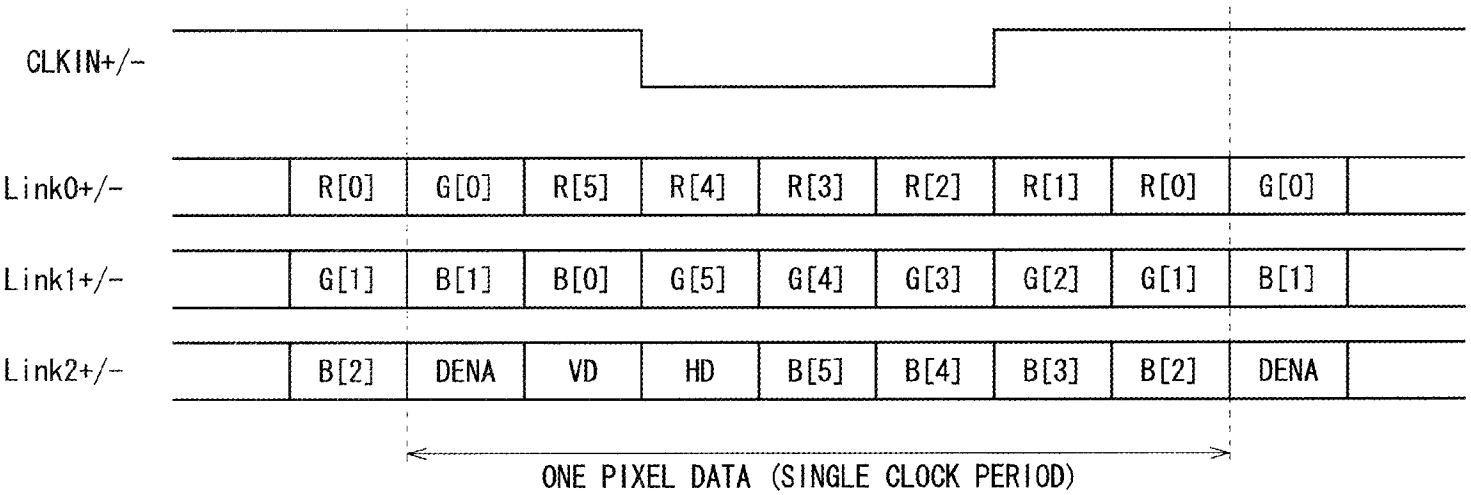
FIG. 10 is a view illustrating a mapping configuration of image signals to be input to the liquid crystal module according to the underlying technique.

FIG. 10 is a view illustrating a mapping configuration of 6-bit RGB image signals to be input to a liquid crystal module via a transmission technology of LVDS according to an underlying technique.

In the case where the mapping has no free space (a time domain which has none of the image signals or the like allocated) as illustrated in FIG. 10, the approach of the first preferred embodiment is not available. Then, in the second preferred embodiment, a particular combination of a plurality of control signals allocated in a clock period is used.

Assuming that the control signals (DENA, HD, VD) are defined as in the first preferred embodiment, the periods in which HD and VD are in the High state need to synchronize with the period in which DENA is in the High state. Conversely, the periods in which HD and VD are in the Low state synchronized with the period in which DENA is in the High state are impossible combinations of the control signals. In other words, these combinations are unused combinations (particular combinations which have no function allocated).

In the second preferred embodiment, the above described particular combinations of the control signals are treated as equivalent to ENA of the first preferred embodiment.

That is, in the case where all of DENA, HD, and VD are in the High state in the valid period of the image signals, RGB data is used as usual. In contrast, the second preferred embodiment can reduce the number of inversions between the High state and the Low state on the transmission links between the transmitter and the receiver by defining that the case where DENA is in the High state but HD or VD is in the Low state is the case where the image signals are in the valid period and also the combination of the control signals is equivalent to ENA in the High state in the first preferred embodiment.

Figure 11:
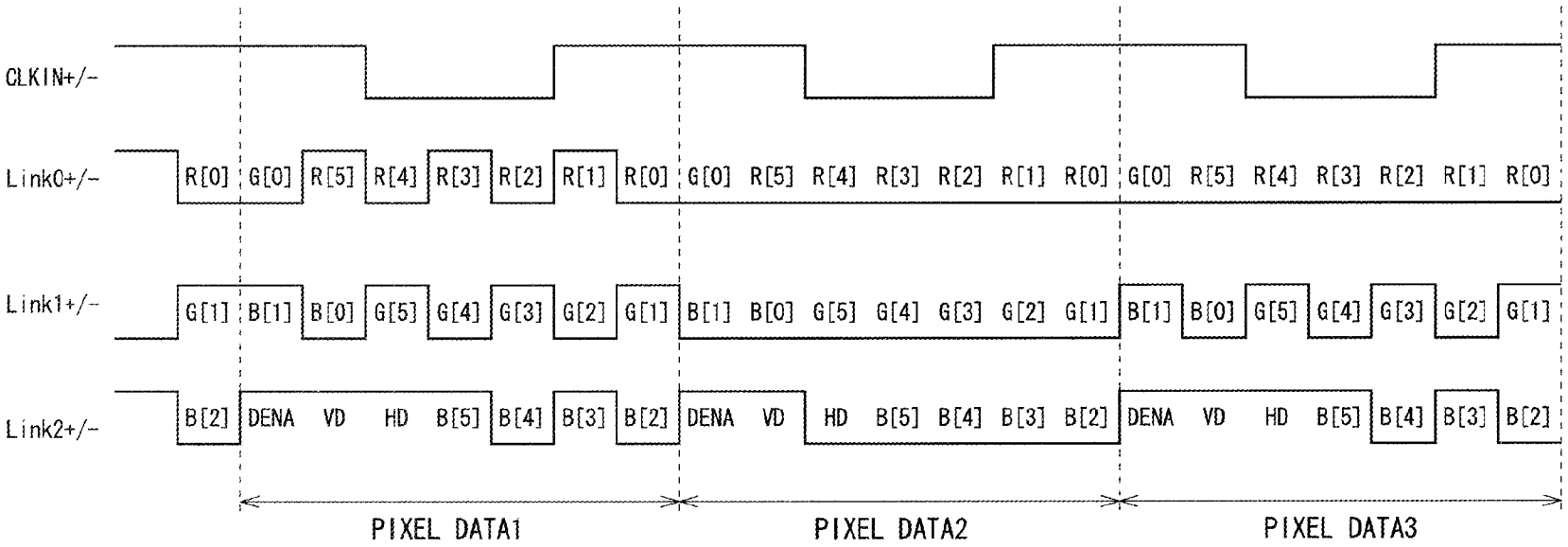
FIG. 11 is a view illustrating a mapping configuration of the image signals including the High state and the Low state of the digital data on each of the transmission links according to the preferred embodiment.

FIG. 11 is a view illustrating a mapping configuration of the image signals including the High state and the Low state of the digital data on the transmission links as in FIG. 7.

Illustrated in the pixel DATA2 is the digital data which has DENA and VD set to the High state, HD set to the Low state, and the other digital data units (at least the image signals) set to the Low state in response to the case where the digital data units (at least the image signals) other than the control signals (DENA, HD, VD) which have been mapped in the preceding clock period (the pixel DATA1 period) and the digital data units (at least the image signals) other than the control signals (DENA, HD, VD) mapped in the pixel DATA2 period are the same.

In the preferred embodiment, when the image signals are to be mapped at the transmitter side, the comparing unit 50 of the data transmission apparatus compares the digital data units (at least the image signals) other than the control signals (DENA, HD, VD) which have been mapped in the preceding clock period with the corresponding digital data units (at least the image signals) other than the control signals (DENA, HD, VD) which have been mapped in the next clock period. In the case where at least some of the digital data units are different, the flag setting unit 51 of the data transmission apparatus sets DENA, HD, and VD to the High state (i.e., sets a flag signal (mark) indicating the comparison result) and outputs the other digital data units intact (i.e., by keeping the time domains which have the respective signals allocated and the High state or the Low state of the respective signals as they are) (corresponding to the pixel DATA3). Then, the digital data is transmitted on the transmission links.

In contrast, in the case where the comparing unit 50 of the data transmission apparatus compares the digital data units (at least the image signals) other than the control signals (DENA, HD, VD) which have been mapped in the preceding clock period with the corresponding digital data units (at least the image signals) other than the control signals (DENA, HD, VD) which have been mapped in the next clock period to find that they are the same (all of the digital data units are the same), the flag setting unit 51 of the data transmission apparatus sets DENA to the High state, HD to the Low state, and VD to the High state (i.e., sets a flag signal (mark) indicating the comparison result) and the cancelling unit 53 of the data transmission apparatus sets all of the other digital data units to the Low state to cancel them (corresponding to the pixel DATA2). Then, the digital data is transmitted on the transmission links.

In response, at the receiver side, in the case where the states of the control signals are other than DENA=the High state, HD=the Low state, and VD=the High state, the digital data in the clock period is recognized as it is, and in the case where DENA=the High state, HD=the Low state, and VD=the High state, the received digital data is not recognized and the digital data in the preceding clock period is to be reused (and also the control signals need to be returned to DENA=the High state, HD=the High state, and VD=the High state).

Figure 12:
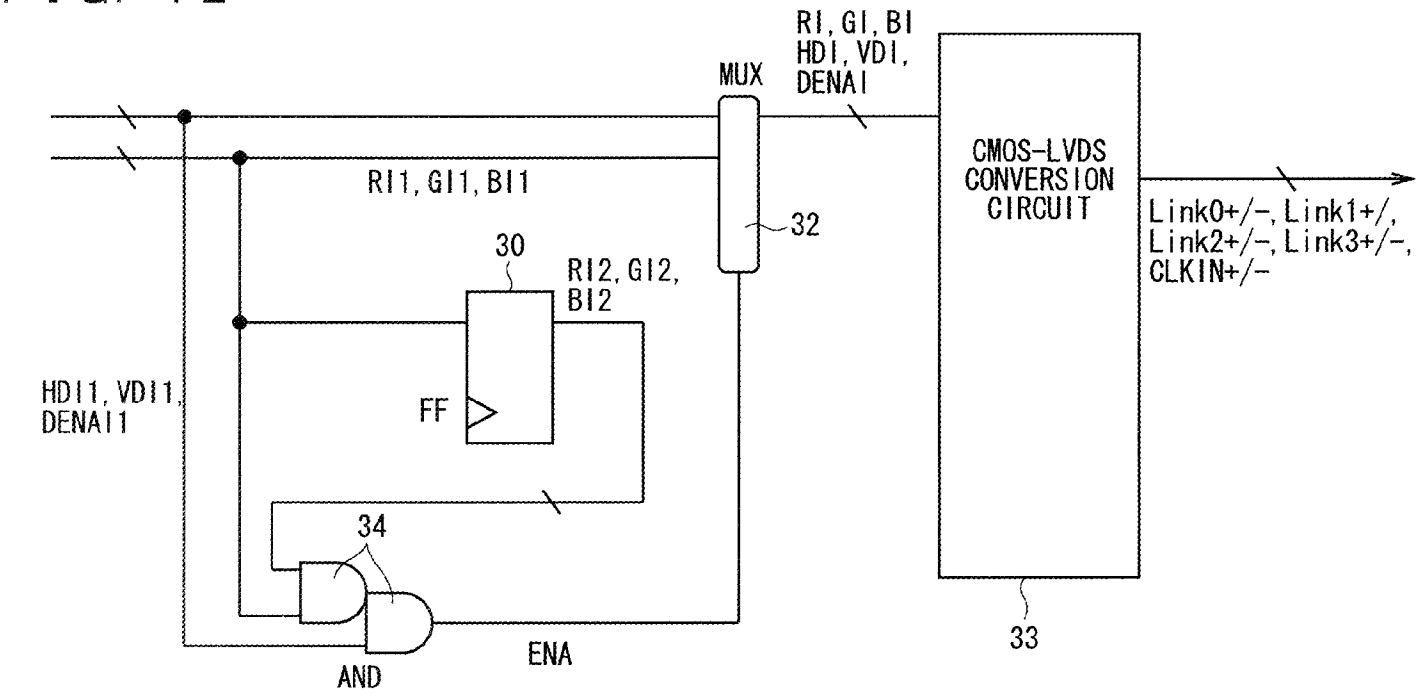
FIG. 12 is a view illustrating a circuit for implementing a preferred embodiment at a transmitter side.
Figure 13:
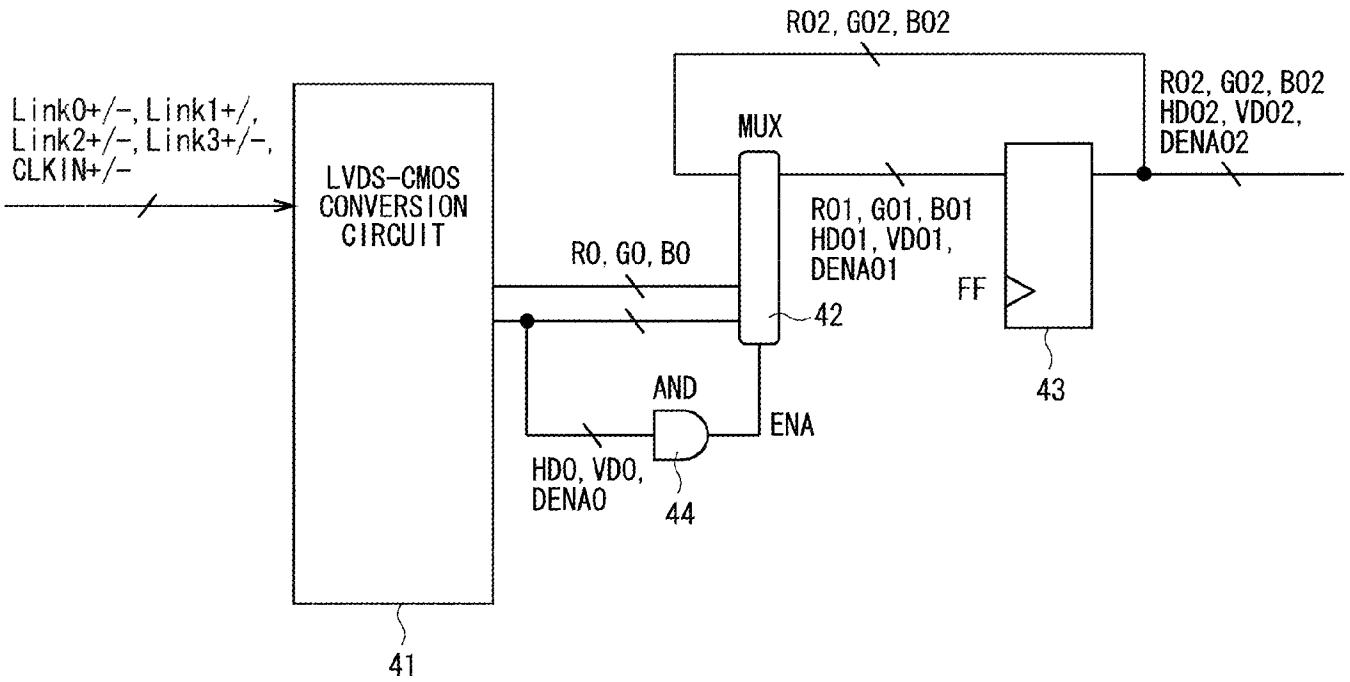
FIG. 13 is a view illustrating a circuit for implementing the preferred embodiment at a receiver side.

Now, circuits for implementing the second preferred embodiment at the transmitter side (corresponding to the above described scaler chip 15) are illustrated in FIG. 12 and circuits for implementing the second preferred embodiment at the receiver side (corresponding to the above described timing controller 14) are illustrated in FIG. 13.

In FIG. 12, a sequence of operation goes on as below.

The data transmission apparatus delays the image signals (RI1, GI1, BI1) for one clock at a flip-flop circuit 30 to generate the image signals (RI2, GI2, BI2) respectively.

Subsequently, at an AND circuit 34, the data transmission apparatus compares the digital data in the preceding clock period (RI2, GI2, BI2) with the digital data in the next clock period (RI1, GI1, BI1) for each bit (corresponding to the comparing unit 50). Then, the data transmission apparatus compares all of the bits with each other, i.e., compares to determine whether the digital data in the preceding clock period completely agrees with the corresponding digital data in the next clock period or not.

Further, the data transmission apparatus determines whether the digital data is in a valid pixel period (DENA=the High state, HD=the High state, VD=the High state) or not, and outputs the result as ENA (corresponding to the flag setting unit 51). In the case where ENA=the High state (in the case where the digital data units completely agree with each other), the data transmission apparatus outputs all of the digital data units (RI, GI, BI) from a MUX 32 in the Low state (corresponding to the cancelling unit 53). Further, the data transmission apparatus sets the control signals to DENAI=the High state, HDI=the Low state, VDI=the High state and outputs them from the MUX 32. In the case where ENA=the Low state (in the case where at least some of the digital data units disagree with each other), data transmission apparatus outputs the digital data (RI1, GI1, BI1, HDI1, VDI1, DENAI1) intact as the digital data (RI, GI, BI, HDI, VDI, DENAI) from the MUX 32 to a CMOS-LVDS conversion circuit 33. Then, the digital data is transmitted on the transmission links.

In FIG. 13, a sequence of operation goes on as below.

One of the control signals output from a LVDS-CMOS conversion circuit 41 as CMOS signals (DENAO, HDO, VDO) is input to a MUX 42 and the other is input to an AND circuit 44.

The data transmission apparatus determines whether DENAO=the High state, HDO=the Low state, and VDO=the High state or not in the AND circuit 44, and in the case where DENAO=the High state, HDO=the Low state, and VDO=the High state, it sets ENA to the High state, and if otherwise, it sets ENA to the Low state. ENA is used in the MUX 42 and, in the case where ENA=the High state (in the case where the digital data units completely agree with each other), the data transmission apparatus outputs the digital data in the preceding clock period which has been fed back to the MUX 42 (RO2, GO2, BO2) intact as the digital data (RO1, GO1, BO1) instead of using the received digital data (corresponding to the output controlling unit 52) and sets the control signals to HDO1=the High state, VDO1=the High state, and DENAO1=the High state. In the case where the output controlling unit 52 refers to the received digital data to find that the image signals in the digital data are cancelled (for example, the image signals are set to the Low state) even though the flag signal using the combination of the control signals is not set, the data transmission apparatus can also output the digital data in the preceding clock period which has been fed back to the MUX 42 (RO2, GO2, BO2) intact as the digital data (RO1, GO1, BO1) (corresponding to the output controlling unit 52).

In the case where ENA=the Low state (in the case where at least some of the digital data units disagree with each other), the data transmission apparatus outputs the received digital data in the next clock period (RO, GO, BO, HDO, VDO, DENAO) intact as the digital data (RO1, GO1, BO1, HDO1, VDO1, DENAO1) (corresponding to the output controlling unit 52). In the case where the output controlling unit 52 refers to the received digital data to find that the image signals in the digital data are not cancelled (for example, inversions between the High state and the Low state remain in the image signals) even though the flag signal using the combination of the control signals is not set, the data transmission apparatus can also output the received digital data in the next clock period (RO, GO, BO, HDO, VDO, DENAO) intact (corresponding to the output controlling unit 52).

The digital data (RO2, GO2, BO2, HDO2, VDO2, DENAO2) is the digital data (RO1, GO1, BO1, HDO1, VDO1, DENAO1) delayed for one clock in a flip-flop circuit 43, therefore, in the case where ENA=the High state, the above described operation is equivalent to the reuse of the digital data of the preceding clock period.

In the case where the digital data in the preceding clock period is output for reuse, all of the digital data units other than ENA are transmitted on the transmission links between the transmitter and the receiver as cancelled (in the Low state). Therefore, in that operation, the data transmission apparatus has reduced the number of inversions between the High state and the Low state on the transmission links between the transmitter and the receiver.

As described above, the present invention can be implemented only with addition of simple circuits at both of the transmitter side and the receiver side.

As a result, the preferred embodiment can reduce the number of inversions between the High state and the Low state, which are transmitted by means of difference, on the transmission links between the transmitter and the receiver by adding the simple circuits at both of the transmitter side and the receiver side, therefore, the preferred embodiment can reduce noise emitted as electromagnetic waves from the transmission links.

Although, in the second preferred embodiment, the combination of DENA=the High state, HD=the Low state, and VD=the High state is defined as equivalent to ENA=the High state in the first preferred embodiment, the combination of DENA=the High state, HD=the High state, and VD=the Low state may be defined as equivalent to ENA=the High state.

<Effects>

According to the preferred embodiment, the flag setting unit 51 sets the flag signal to the particular combination of the plurality of control signals in the digital data in the second clock period which indicate details of control performed on the image.

With that configuration, the preferred embodiment can set the flag signal by effectively using the particular combination which has no function of the control signal allocated.

Although the case where all of the digital data units other than the flag signal are set to the Low state is used as a method of cancelling the image signals in the above described preferred embodiment, even the case where all of the digital data units other than the flag signal are set to the High state may be applied as the method of cancelling the image signals. In the latter case, the High state and the Low state of the voltages to be set to the flag signals only need to be reversed too.

Although all of the image signals in a single clock period are cancelled in the above described preferred embodiment, the present invention may be adapted to cancel some of the image signals of the plurality of image signals allocated to a single clock period.

Although the above described preferred embodiment is explained by exemplifying a case of using the LVDS technology, the present invention can be easily applied to the cases where such interface technologies for compressing and transmitting other images and synchronizing signals as DVI (Digital Visual Interface) and HDMI (High-Definition Multimedia Interface) (registered trademark) are used.

Although the quality of the material, the materials, the conditions of implementation and the like of the respective constituent elements have been mentioned in the above described preferred embodiment, they are intended for illustration and are not intended for restriction.

Random combinations of the preferred embodiments, modifications of optional constituent elements of the preferred embodiments, or optional omissions of the constituent elements of the preferred embodiments may fall within the scope of the present invention.

While the invention has been shown and described in detail, the foregoing description is in all aspects illustrative and not restrictive. It is therefore understood that numerous modifications and variations can be devised without departing from the scope of the invention.

What is claimed is:

1. A data transmission apparatus that serially transmits a plurality of image signals to an image display device by using digital data which has said image signals allocated in a single clock period, comprising:

a comparing unit that compares each of said image signals in a first clock period with a corresponding one of said image signals in a second clock period subsequent to said first clock period; and a cancelling unit that causes each of said image signals in said second clock period to be cancelled in the case where a comparison result from said comparing unit indicates that each of said image signals in said first clock period agrees with said corresponding one of said image signals in said second clock period, wherein said cancelling unit causes each of said image signals in said second clock period to be canceled by eliminating a difference between a High state and a Low state of said digital data corresponding to said image signals allocated to continuous time domains of said second clock period.

2. The data transmission apparatus according to claim 1, further comprising a flag setting unit that sets a flag signal in said digital data in said second clock period in the case where a comparison result from said comparing unit indicates that each of said image signals in said first clock period agrees with said corresponding one of said image signals in said second clock period.

3. The data transmission apparatus according to claim 2, wherein said cancelling unit causes all of said image signals in said second clock period to be canceled by setting all of said digital data except for said flag signal in said second clock period to a High state or to a Low state.

4. The data transmission apparatus according to claim 2, wherein said flag setting unit sets said flag signal to a time domain of said digital data of said second clock period, and wherein none of said image signals are allocated to said time domain.

5. The data transmission apparatus according to claim 2, wherein said flag setting unit sets said flag signal to a particular combination of a plurality of control signals in said digital data in said second clock period, the plurality of control signals indicating details of control performed on an image.

6. The data transmission apparatus according to claim 1, further comprising an output controlling unit that causes said image display device to output an image based on each of said image signals in said first clock period in the case where each of said image signals in said second clock period has been subjected to said cancelling.

7. The data transmission apparatus according to claim 6, further comprising a flag setting unit that sets a flag signal in said digital data in said second clock period in the case where a comparison result from said comparing unit indicates that each of said image signals in said first clock period agrees with said corresponding one of said image signals in said second clock period, wherein said output controlling unit causes said image display device to output an image based on each of said image signals in said first clock period in the case where said flag signal is set.

8. A data transmission method for serially transmitting a plurality of image signals to an image display device by using digital data which has said image signals allocated in a single clock period, comprising the steps of:

(a) comparing each of said image signals in a first clock period with a corresponding one of said image signals in a second clock period subsequent to said first clock period; and (b) causing each of said image signals in said second clock period to be cancelled in the case where a comparison result in said step (a) indicates that each of said image signals in said first clock period agrees with said corresponding one of said image signals in said second clock period, wherein said step (b) is the step of causing each of said image signals in said second clock period to be canceled by eliminating a difference between a High state and a Low state of said digital data corresponding to said image signals allocated to continuous time domains of said second clock period.

9. The data transmission method according to claim 8, further comprising (c) a step of setting a flag signal in said digital data in said second clock period in the case where a comparison result in said step (a) indicates that each of said image signals in said first clock period agrees with said corresponding one of said image signals in said second clock period.

10. The data transmission method according to claim 9, wherein said step (b) is the step of causing all of said image signals in said second clock period to be canceled by setting all of said digital data except for said flag signal in said second clock period to a High state or to a Low state.

11. The data transmission method according to claim 9, wherein said step (c) is the step of setting said flag signal to a time domain of said digital data of said second clock period, and wherein none of said image signals are allocated to said time domain.

12. The data transmission method according to claim 9, wherein said step (c) is the step of setting said flag signal to a particular combination of a plurality of control signals in said digital data in said second clock period, the plurality of control signals indicating details of control performed on an image.

13. The data transmission method according to claim 8, further comprising (d) a step of causing said image display device to output an image based on each of said image signals in said first clock period in the case where each of said image signals in said second clock period has been subjected to said cancelling.

14. The data transmission method according to claim 13, further comprising (c) a step of setting a flag signal in said digital data in said second clock period in the case where a comparison result in said step (a) indicates that each of said image signals in said first clock period agrees with said corresponding one of said image signals in said second clock period, wherein said step (d) is the step of causing said image display device to output an image based on each of said image signals in said first clock period in the case where said flag signal is set in said step (c).

* * * * *